US005523648A

United States Patent [19]

Son et al.

[11] Patent Number: 5,523,648

[45] Date of Patent: Jun. 4, 1996

[54] ELECTRON GUN WITH DYNAMIC FOCUS

[75] Inventors: Wan-Jae Son; Yu-Seon Kim, both of Kyungki-do, Rep. of Korea

[73] Assignee: Samsung Electron Devices, Kyungki-do, Rep. of Korea

[21] Appl. No.: 29,593

[22] Filed: Mar. 11, 1993

[30] Foreign Application Priority Data

May 19, 1992 [KR] Rep. of Korea ..... 92-8600

[51] Int. Cl.[6] ..... H01J 29/50

[52] U.S. Cl. ..... 313/414; 315/382

[58] Field of Search ..... 315/382, 15, 16; 313/414

[56] References Cited

U.S. PATENT DOCUMENTS

| | | | |
|---|---|---|---|
| 3,995,194 | 11/1976 | Blacker, Jr. et al. | 315/16 |
| 4,253,041 | 2/1981 | Blacker et al. | 315/16 |
| 4,701,678 | 10/1987 | Blacker et al. | 315/382 |
| 5,025,189 | 6/1991 | Son . | |
| 5,036,258 | 7/1991 | Chen et al. | 313/414 |
| 5,038,073 | 8/1991 | Son . | |
| 5,164,640 | 11/1992 | Son et al. . | |
| 5,281,892 | 1/1994 | Kweon et al. | 313/414 |
| 5,281,896 | 1/1994 | Bae et al. | 315/15 |
| 5,300,854 | 4/1994 | Kweon | 313/414 |
| 5,300,855 | 4/1994 | Kweon | 313/414 |
| 5,341,070 | 8/1994 | Son | 313/414 |

*Primary Examiner*—Sandra L. O'Shea
*Assistant Examiner*—Vip Patel
*Attorney, Agent, or Firm*—Leydig, Voit & Mayer

[57] ABSTRACT

An electron gun for a color cathode ray tube includes a triode having a cathode, a control electrode and a screen electrode for producing an electron beam, and first, second, third and fourth focus electrodes and a final accelerating electrode for accelerating and focusing the electron beam. A predetermined static focus voltage is supplied to the first and third focus electrodes, a dynamic focus voltage synchronized with a deflection signal is supplied to the second and fourth focus electrodes, and an anode voltage higher than the highest dynamic focus voltage is supplied to the final accelerating electrode. Thus, by means of a dynamic and axially symmetrical lens, astigmatism of the electron beam spot on the periphery of the screen is improved, thereby forming an almost circular beam spot. Due to the dynamic variation of intensity of the main lens, the spot size on the periphery of the screen approaches is the spot size on the center of the screen through adjustment of the focusing distance of the electron beam.

3 Claims, 2 Drawing Sheets

ELECTRON GUN WITH DYNAMIC FOCUS

BACKGROUND OF THE INVENTION

The present invention relates to an electron gun for a color cathode ray tube, and more particularly to a dynamic focus electron gun capable of forming beam spots with small halos on the periphery of a screen and beam spots of regular size on both the center and periphery of the screen.

The resolution of a color cathode ray tube greatly depends on the characteristic of electron beam spots formed on a screen. To obtain an image of good quality, the electron beam spot formed on the screen should be as small as possible with the smallest halo around its core. Of course, it is desirable for the beam spot to experience as little distortion as possible. However, since conventional RGB electron guns are arranged in-line and a deflection yoke is adopted which forms a pincushion horizontal deflection magnetic field and a barrel vertical deflection magnetic field, electron beam spots formed on the periphery of the screen become distorted due to the influence of astigmatism while electron beams pass through an uneven magnetic field formed by the deflection yoke.

In other words, when electron beams land on the center of a screen, where the deflection magnetic field does not affect the beams, astigmatism of the electron beams does not occur, and a circular electron beam spot without halo is formed. However, when deflecting toward the periphery of the screen, owing to a strong deflection magnetic field, the electron beams diverge in the horizontal direction and are excessively focused in the vertical direction, so that electron beam spots having a bright core and a dim halo are formed on the screen.

One example of an electron gun for a conventional color cathode ray tube designed to improve the above-described problem is illustrated in FIG. 1.

This electron gun includes a triode for producing an electron beam consisting of a cathode 2, a control electrode 3 and a screen electrode 4, and a major lens for accelerating and focusing the electron beam consisting of a static focus electrode 5 adjacent to screen electrode 4, a dynamic focus electrode 6 and a final accelerating electrode 7.

Vertically-elongated electron beam passing hole 5H and horizontally-elongated electron beam passing hole 6H are respectively formed in the electron beam passing planes of static focus electrode 5 and dynamic focus electrode 6 which face each other. Static focus electrode 5 is supplied with a predetermined static focus voltage Vf. Final accelerating electrode 7 is supplied with an anode voltage Ve being higher than focus voltage Vf. Dynamic focus electrode 6 is supplied with a dynamic focus voltage Vd which is synchronized with deflection signals and its negative peak equals focus voltage Vf.

A reference numeral 100 is a magnetic lens which represents the uneven magnetic field of the deflection yoke by means of an optical lens.

In the above-described electron gun, when the electron beam is not deflected, in other words, when the electron beam emitted from the electron gun scans the center of the screen, dynamic focus voltage Vd whose negative peak voltage equals focus voltage Vf is supplied to dynamic focus electrode 6. Therefore, a lens capable of controlling the electron beam is not formed between static and dynamic focus electrodes 5 and 6. Thus, the electron beam maintains an unaffected circular shape when passing static and dynamic focus electrodes 5 and 6, and a nearly circular beam spot is formed on the screen.

Meanwhile, when the electron beams emitted from cathode 2 scans the periphery of the screen, dynamic focus voltage Vd being higher than static focus voltage Vf supplied to static focus electrode 5 is applied to dynamic focus electrode 6, so that an electron lens, particularly a quadrupole lens 56, is formed between focus electrode 5 and dynamic focus electrode 6. This quadrupole lens 56 is composed of a first lens element 56*a* which has a diverging force in the vertical direction and a second lens element 56*b* which has a focusing force in the horizontal direction, due to the vertically-elongated electron beam passing hole 5H formed in the outgoing plane of static focus electrode 5 and the horizontally-elongated electron beam passing hole 6H formed in the incoming plane of dynamic focus electrode 6. Accordingly, the electron beam diverges in the vertical direction and focuses in the horizontal direction while passing through quadrupole lens 56, thereby being vertically elongated. Then, the narrow width in the horizontal direction of the vertically elongated electron beam is compensated by compensating for defocusing due to the vertical excessive focusing by the uneven magnetic field, so that a beam spot without halo can be obtained on the screen.

In the conventional dynamic focus electron gun, since dynamic focus voltage Vd is higher than static focus voltage Vf at the center of the screen, an extremely high dynamic focus voltage Vd must be supplied to eliminate the halo along the diagonal lines of the screen. However, it is difficult to realize a driving circuit for supplying voltages to each electrode of the triode. Moreover, the withstand voltage characteristic of the electron gun is deteriorated.

Furthermore, in the electron gun, although occurrence of a halo at the periphery of the screen can be suppressed by the quadrupole lens, a compensation effect on the cross-sectional shape of the electron beam caused by the deflection magnetic field of the deflection yoke is incomplete. For this reason, distortion of the electron beam spot cannot be sufficiently compensated which makes the size of the vertical beam spot smaller than the distance between apertures of the shadow mask, and a moiré effect occurs on the screen when the vertical diameter of the beam spot is not more than twice the distance between apertures of the shadow mask.

SUMMARY OF THE INVENTION

The present invention is designed to solve the above-described problems. Accordingly, it is the object of the present invention to provide an electron gun for a color cathode ray tube capable of effectively compensating distortion of electron beam spots landing on the periphery of a screen, and forming electron beam spots of regular size throughout the screen.

To achieve the above object of the present invention, there is provided an electron gun for a color cathode ray tube comprising a triode having a cathode, a control electrode and a screen electrode for producing an electron beam, and first, second, third and fourth focus electrodes and a final accelerating electrode for accelerating and focusing the electron beam, wherein a vertically-elongated electron beam passing hole and a horizontally-elongated electron beam passing hole are respectively formed in the outgoing plane of the third focus electrode and the incoming plane of the fourth focus electrode;

a predetermined static focus voltage is supplied to the first and third focus electrodes;

a dynamic focus voltage synchronized with a deflection signal is supplied to the second and fourth focus electrodes; and an anode voltage higher than the highest dynamic focus voltage is supplied to the final accelerating electrode.

BRIEF DESCRIPTION OF THE DRAWINGS

These and other objects, features, aspects and advantages of the present invention will become more apparent from the following detailed description of the present invention when taken in conjunction with the accompanying drawings, in which.

DETAILED DESCRIPTION OF THE INVENTION

Figure 1:
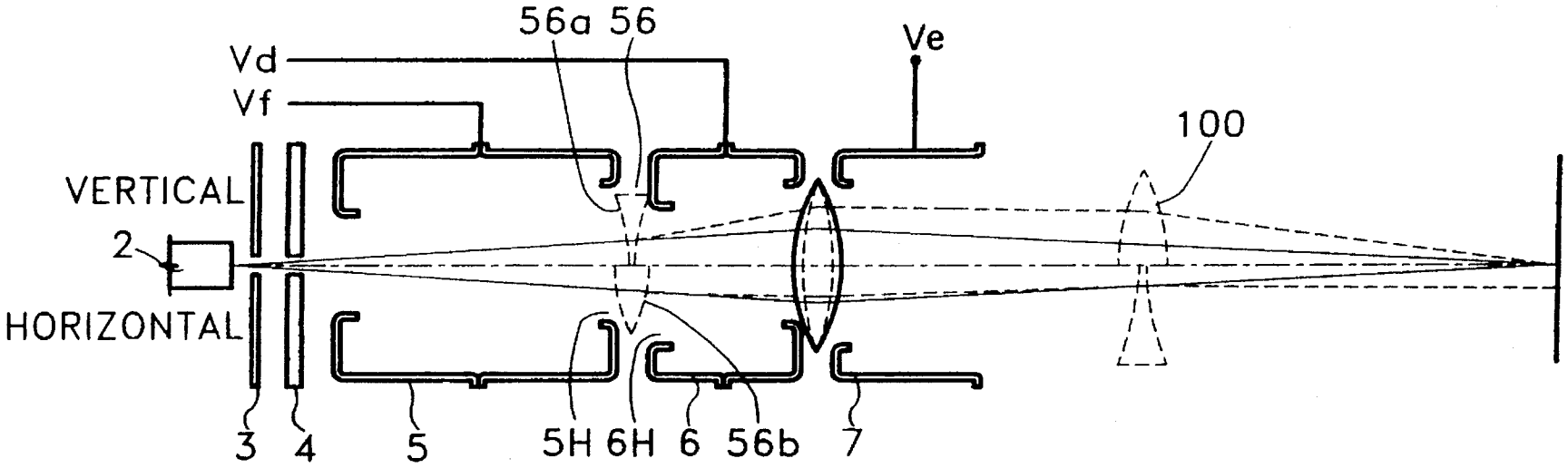
FIG. 1 (PRIOR ART)
FIG. 1 is a perspective view of a conventional electron gun for a color cathode ray tube.
Figure 2:
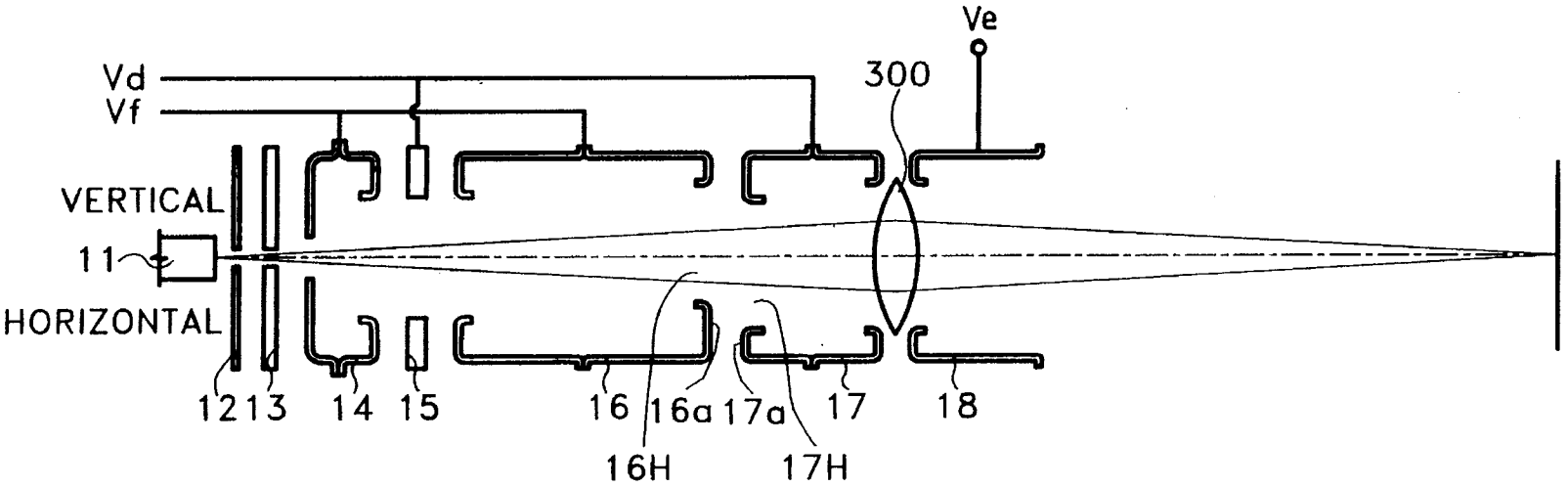
FIG. 2 is a sectional view of an electron gun for a color cathode ray tube according to the present invention showing the controlled electron beam state when scanning the center of the screen.

Referring to FIG. 2, a triode for producing an electron beam consists of a cathode 11, a control electrode 12 and a screen electrode 13, which are sequentially arranged in the front part of an electron gun. Subsequent to screen electrode 13, electrodes of a major lens system for accelerating and focusing the electron beam are provided. The major lens system is composed of a first auxiliary lens formed by first, second and third focus electrodes 14, 15 and 16; a second auxiliary lens formed by third and fourth focus electrodes 16 and 17; and a main lens 300 formed by fourth focus electrode 17 and a final accelerating electrode 18.

In more detail, a vertically-elongated electron beam passing hole 16H is formed in an outgoing plane 16*a* of third focus electrode 16, and a horizontally-elongated electron beam passing hole 17H is formed in an incoming plane 17*a* of fourth focus electrode 17. The shape of respective vertically and horizontally elongated electron beam passing holes 16H and 17H are rectangular or elliptic.

Figure 3:
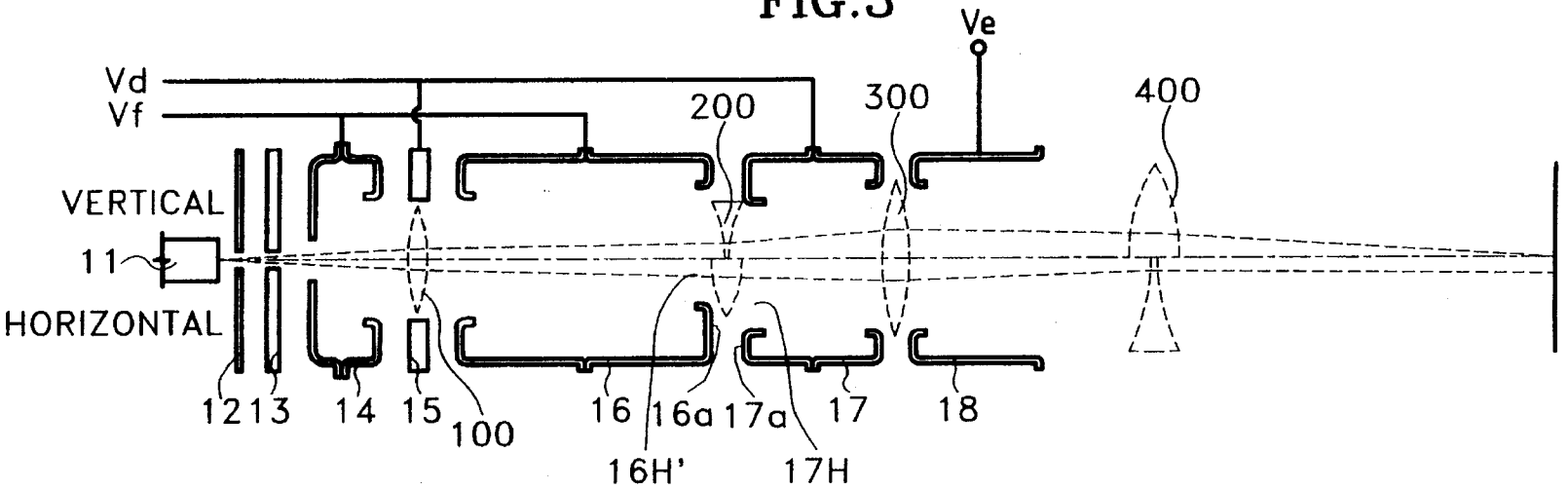
FIG. 3 is a sectional view of the electron gun for the color cathode ray tube according to the present invention showing the controlled electron beam state when scanning the periphery of the screen.

In the electron gun formed as above according to the present invention, a predetermined static focus voltage Vf is supplied to first and third focus electrodes 14 and 16. A dynamic focus voltage Vd is supplied to second and fourth focus electrode 15 and 17. Dynamic focus voltage Vd is synchronized with a deflection signal of the cathode ray tube. Also, an anode voltage Ve which is higher than the highest voltage of dynamic focus voltage Vd is supplied to final accelerating electrode 18. In FIG. 3, reference numeral 400 represents a magnetic lens which represents the uneven magnetic field of a deflection yoke (not shown) as an optical lens. Preferably, $V_c$ is in the range of 20 kV to 35 kV while $V_f$ is preferably in the range of 20% to 35% of $V_c$.

In the electron gun for the color cathode ray tube according to the present invention formed as above, the electron beam produced from the triode is focused and accelerated by a plurality of lenses formed between adjacent electrodes, while passing through the beam passing holes of each electrode. When the electron beam scans the center of the screen, second and fourth focus electrodes 15 and 17 are supplied with dynamic focus voltage Vd which equals $V_f \pm 800\ V_{p\text{-}p}$. Preferably the negative peak of dynamic focus voltage $V_d$ equals static focus voltage $V_f$ supplied to first and third focus electrodes 14 and 16. At this time, there is no potential difference between static focus electrodes 14 and 16 and dynamic focus electrodes 15 and 17, and thus a lens is not formed between the focus electrodes but a main lens is formed between the last dynamic focus electrode 17 and accelerating electrode 18. Therefore, as shown in FIG. 2, the electron beam maintains its circular cross-section since it is not affected while passing through the focus electrodes. Then, the electron beam is simply accelerated and focused while finally passing through the main lens 300, thereby forming a circular spot on the center of the screen.

When the electron beam scans the periphery of the screen, second and fourth focus electrodes 15 and 17 are supplied with dynamic focus voltage Vd being higher than the focus voltage of the first and third focus electrodes 14 and 16. The dynamic focus voltage $V_d$ is preferably equal to $V_f \pm 2000\ V_{p\text{-}p}$. Thus, as shown in FIG. 3, an axially symmetrical unipotential-type first auxiliary lens 100 whose focusing force is increased by being synchronized with a deflection signal is formed between first, second and third focus electrodes 14, 15 and 16, and a quadrupole second auxiliary lens 200 whose diverging and focusing forces are increased by being synchronized with the deflection signal is formed between focus electrodes 16 and 17. Also, a relatively weakened main lens 300 is formed between fourth and fifth focus electrodes 17 and 18.

Accordingly, the electron beam is prefocused and accelerated by first auxiliary lens 100 formed between first, second and third focus electrodes 14, 15 and 16, and then focused and accelerated again by second auxiliary lens 200 formed between third and fourth focus electrodes 16 and 17. Here, second auxiliary lens 200 is a quadrupole lens, so that the electron beam deflects in the vertical direction and diverges in the horizontal direction less than in the vertical direction. In more detail, since vertically-elongated electron beam passing hole 16H is formed in outgoing side 16*a* of third focus electrode 16 and horizontally-elongated electron beam passing hole 17H is formed in incoming side 17*a* of fourth focus electrode 17, the electron beam which has passed through second auxiliary lens 200 is subjected to a strong diverging force and weak focusing force in the vertical direction, and a strong focusing force and weak diverging force in the horizontal direction.

Therefore, the electron beam having passed through the passing holes is vertically elongated when passing through second auxiliary lens 200. Successively, the electron beam is finally focused and accelerated while passing through main static lens 300, thereby landing on the periphery of the screen. At this time, because the electron beam passes through the magnetic lens created by the uneven deflection magnetic field of the deflection yoke, distortion of the beam is compensated, thereby forming a nearly circular spot.

Moreover, due to the high potential dynamic focus voltage, the potential difference between fourth focus electrode 17 and final accelerating electrode 18 is decreased as compared with that during the scanning of the center of the screen, and the magnification of main lens 300 is decreased nearly as much. Consequently, the focusing distance of the electron beam having passed through the lens is lengthened, which allows the spot size on the periphery of the screen to be similar to that formed on the center of the screen.

The unipotential-type first auxiliary lens particularly increases the incident angle to the main lens and the diameter of the beam spot on the center of the screen, so that the offset effect of the repulsion between electrons due to the increase of spherical aberration is increased. Thus, the diameter of beam spot becomes small, so that resolution is increased. Also, when deflecting toward the periphery of the screen, the incident angle toward the main lens and the diameter of the beam spots within the main lens and magnetic lens of the deflection yoke become small, so that spherical aberration is decreased by means of the main lens and the magnetic lens of the deflection yoke. Thus, excessive focusing in the vertical direction is prevented to thereby prohibit moiré effect and the lowering of brightness caused by the beam diameter's excessive reduction in the vertical direction.

In the electron gun according to the present invention described with reference to the embodiment as above, astigmatism of the electron beam spot on the periphery of the screen is reduced by means of a dynamic quadrupole lens, so that a nearly circular beam spot is formed with as small a halo as possible. At the same time, the focusing distance of the electron beam is adjusted by dynamic variations of the main lens, thereby making the beam spot size formed on the periphery of the screen similar to that formed on the center of the screen. As a result, the electron gun according to the present invention can realize a clear image with high resolution throughout the screen.

While the present invention has been particularly shown and described with reference to particular embodiments thereof, it will be understood by those skilled in the art that various changes in form and details may be effected therein without departing from the spirit and scope of the invention as defined by the appended claims.

What is claimed is:

1. An electron gun for a color cathode ray tube comprising:

a triode including a cathode, a control electrode adjacent to and spaced from the cathode and a screen electrode adjacent to and spaced from the control electrode, said triode generating an electron beam;

a lens system including a first electrode supplied with a static voltage, a second electrode supplied with a dynamic voltage and synchronized with a deflection signal, a third electrode supplied with the static voltage and a fourth electrode supplied with the dynamic voltage and synchronized with the deflection signal, said first through fourth electrodes arranged sequentially adjacent to said triode, said third electrode having an incoming plane facing said second electrode and an outgoing plane facing said fourth electrode and having a vertically-elongated electron beam passing hole, and said fourth electrode having an incoming plane facing said outgoing plane of said third electrode and having a horizontally-elongated beam passing hole;

a final accelerating electrode adjacent to and spaced from said fourth electrode, said final accelerating electrode being supplied with a voltage greater than the dynamic voltage and greater than the static voltage, whereby an axially symmetrical and dynamic unipotential-type lens which is synchronized with said deflection signal, is formed by said first, second and third focus electrodes, and a quadruple lens which is synchronized with said deflection signal and compensates for defocusing due to the astigmatism of a deflection yoke and difference between deflection distances, is formed between said third and fourth electrodes.

2. An electron gun for a color cathode ray tube as claimed in claim 1, wherein the shape of said vertically-elongated electron beam passing hole and horizontally-elongated electron beam passing hole is rectangular.

3. An electron gun for a color cathode ray tube as claimed in claim 1, wherein the shape of said vertically-elongated electron beam passing hole and horizontally-elongated electron beam passing hole is elliptic.

* * * * *